US007996947B2

(12) United States Patent
Gueret

(10) Patent No.: US 7,996,947 B2
(45) Date of Patent: Aug. 16, 2011

(54) BRUSH AND A PACKAGING AND APPLICATOR DEVICE INCLUDING SUCH A BRUSH

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1183 days.

(21) Appl. No.: 11/452,234

(22) Filed: Jun. 14, 2006

(65) Prior Publication Data

US 2007/0006891 A1 Jan. 11, 2007

Related U.S. Application Data

(60) Provisional application No. 60/694,994, filed on Jun. 30, 2005.

(30) Foreign Application Priority Data

Jun. 15, 2005 (FR) ..... 05 51639

(51) Int. Cl.
*A46D 1/00* (2006.01)

(52) U.S. Cl. ..... 15/207.2; 15/167.3; 15/195

(58) Field of Classification Search ..... 15/195, 15/207, 272, 206; 401/118, 119, 122, 126, 401/127, 129; 132/218, 312, 320
See application file for complete search history.

(56) References Cited

U.S. PATENT DOCUMENTS

| | | | | |
|---|---|---|---|---|
| 4,841,996 A | | 6/1989 | Gueret | |
| 4,998,315 A | | 3/1991 | Pessis | |
| 5,217,279 A | * | 6/1993 | Newell | 300/21 |
| 5,588,447 A | * | 12/1996 | Gueret | 132/200 |
| 5,743,279 A | * | 4/1998 | Gueret | 132/218 |
| 6,033,143 A | * | 3/2000 | Gueret | 401/129 |
| 6,039,051 A | | 3/2000 | Dorf | |
| 6,059,473 A | * | 5/2000 | Gueret | 401/129 |
| 6,073,634 A | | 6/2000 | Gueret | |
| 6,210,059 B1 | * | 4/2001 | Ramin et al. | 401/126 |
| 6,390,708 B1 | | 5/2002 | Gueret | |
| 6,669,389 B2 | | 12/2003 | Gueret | |
| 2004/0018037 A1 | | 1/2004 | Gueret | |
| 2004/0040567 A1 | | 3/2004 | Rousselet | |
| 2004/0096261 A1 | | 5/2004 | Gueret | |
| 2005/0031401 A1 | | 2/2005 | Gueret | |

FOREIGN PATENT DOCUMENTS

| | | |
|---|---|---|
| CN | 1184619 A | 6/1998 |
| CN | 1196212 A | 10/1998 |
| CN | 1550169 A | 12/2004 |
| EP | 1 374 723 A1 | 1/2004 |
| EP | 1 591 036 A2 | 11/2005 |
| FR | 2 663 826 | 1/1992 |
| FR | 2 825 247 | 12/2002 |
| FR | 2 838 936 | 10/2003 |

* cited by examiner

*Primary Examiner* — Dung Van Nguyen

(74) *Attorney, Agent, or Firm* — Oliff & Berridge, PLC

(57) ABSTRACT

An applicator brush for applying a cosmetic composition may include a stem, and bristles that are supported by the stem. At least 500 of the bristles may include a greatest dimension in cross-section that is strictly less than 6.5/100 mm.

28 Claims, 4 Drawing Sheets

Fig.1
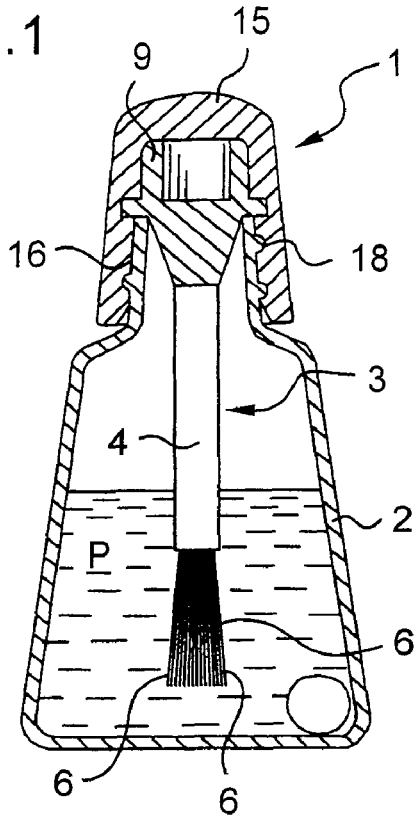
Fig.2
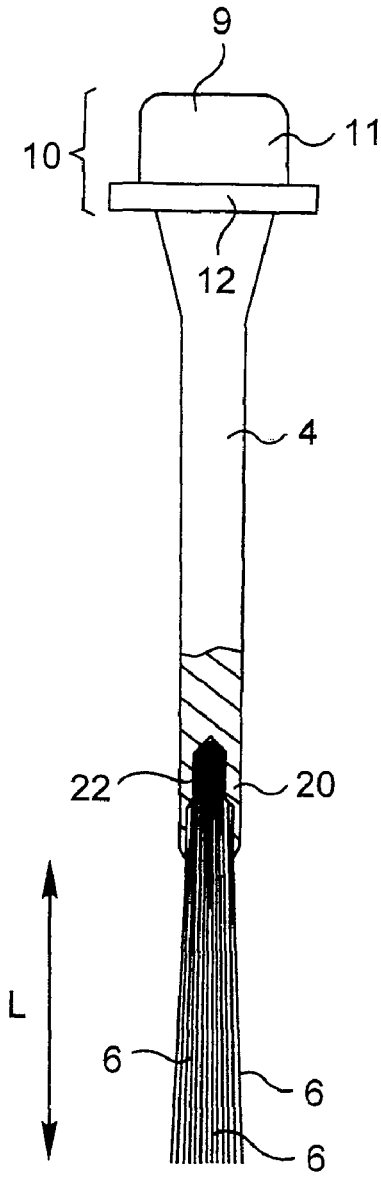
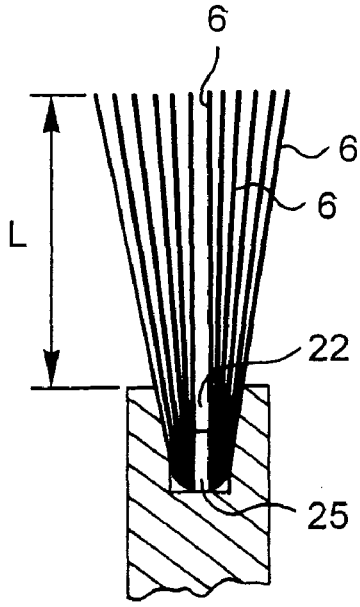
Fig.3

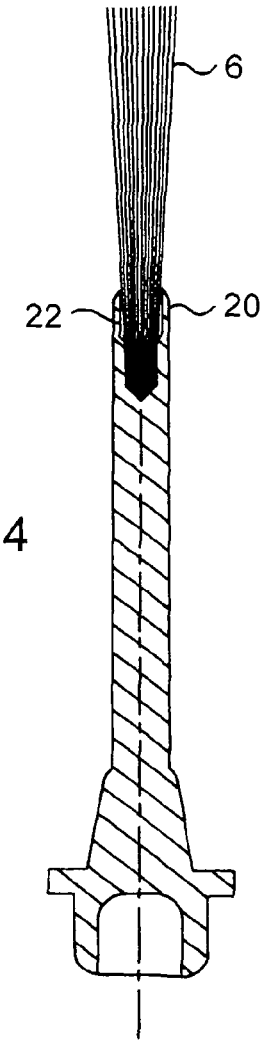
Fig.4
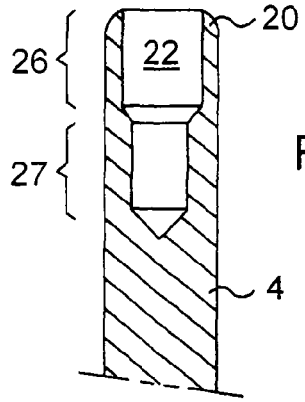
Fig.5
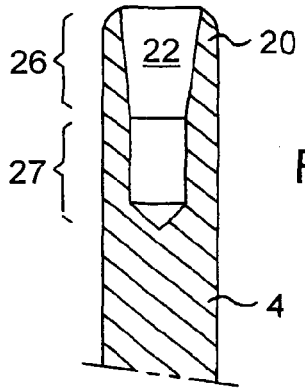
Fig.6
Fig.7
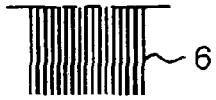
Fig.8
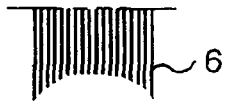
Fig.9
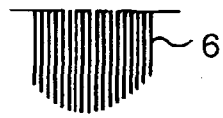
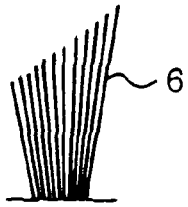
Fig.10
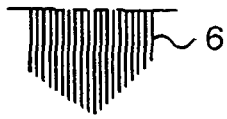
Fig.11

Fig.12
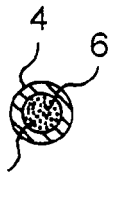
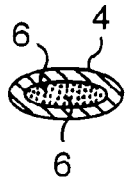
Fig.13
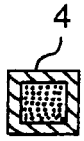
Fig.14
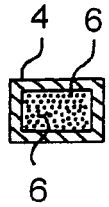
Fig.15
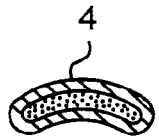
Fig.16
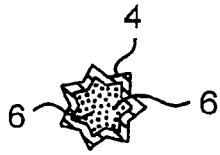
Fig.17
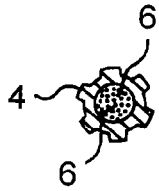
Fig.18
Fig.19
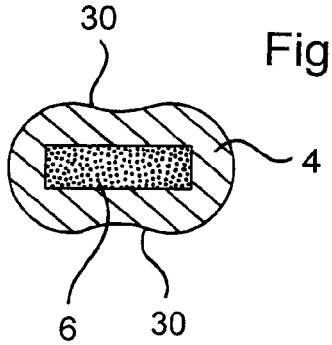
Fig.20
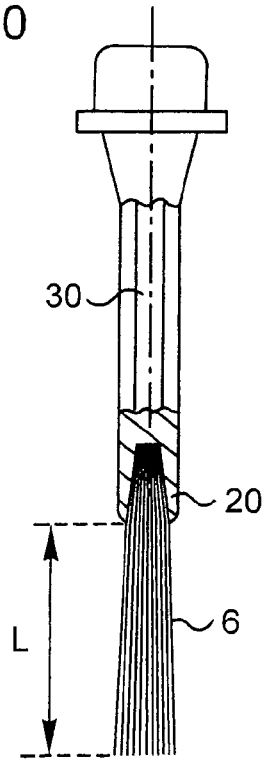
Fig.21
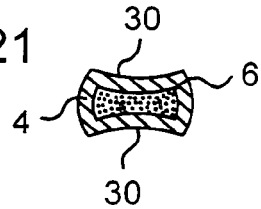
Fig.22
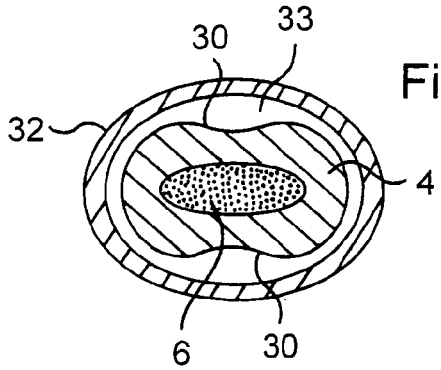

Fig.23
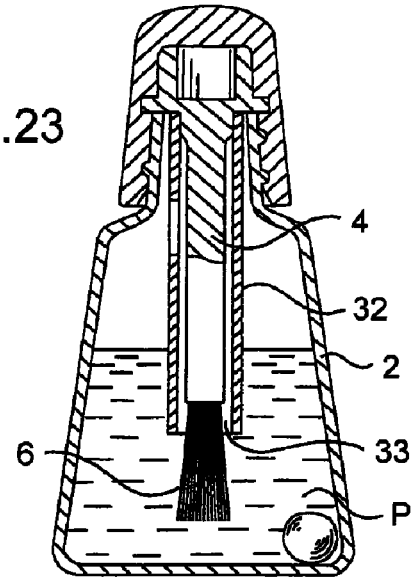
Fig.24
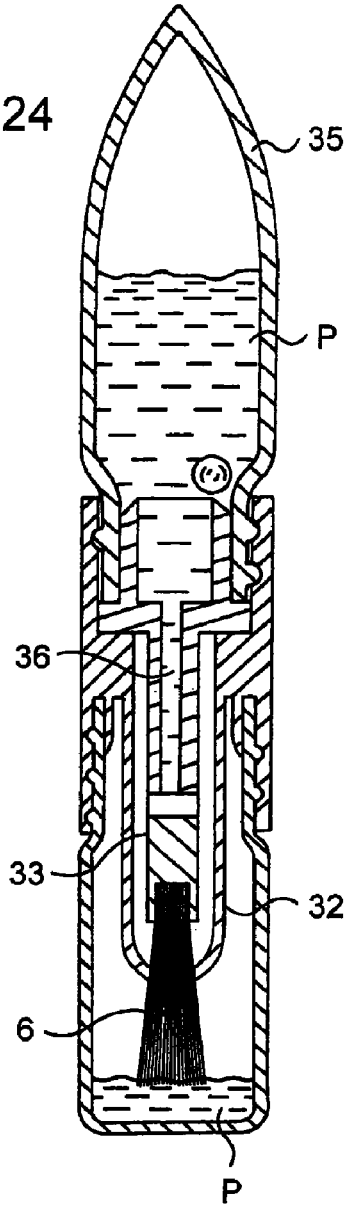
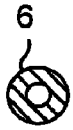
Fig.25
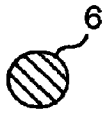
Fig.26
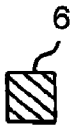
Fig.27
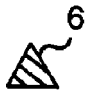
Fig.28
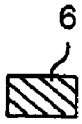
Fig.29
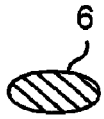
Fig.30
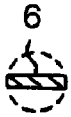
Fig.31
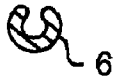
Fig.32
Fig.33
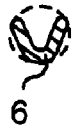
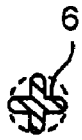
Fig.34
Fig.35
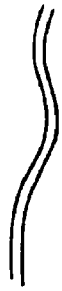

BRUSH AND A PACKAGING AND APPLICATOR DEVICE INCLUDING SUCH A BRUSH

CROSS-REFERENCE TO RELATED APPLICATION

This non-provisional application claims the benefit of French Application No. 05 51639 filed on Jun. 15, 2005, and U.S. Provisional Application No. 60/694,994 filed on Jun. 30, 2005, the entire disclosures of which are incorporated herein by reference.

The present invention relates to applicator brushes for applying a cosmetic, makeup, or a care product, for example, a composition such as a nail varnish or a care product for the nails, and also relates to packaging and applicator devices including such applicator brushes.

BACKGROUND

Known brushes comprise a bundle of bristles fastened to the end of a stem. Such brushes can lead to stripes forming while the composition is being applied, which stripes remain after the composition has dried. To reduce that drawback, free ends of the bristles are tapered by grinding.

SUMMARY

Such grinding operations increases the cost of manufacture. In addition, such grinding operations are not always performed in reproducible and satisfactory manner.

There thus exists a need to benefit from applicator brushes that make it possible, for example, to reduce the formation of stripes during application, without increasing the cost of manufacturing the applicator brush.

Exemplary embodiments of the invention seek, for example, to satisfy that need.

Exemplary embodiments of the invention may provide an applicator brush for applying a composition, for example, a cosmetic, makeup, or a care product, the applicator brush comprising a stem, and bristles that are supported by the stem, at least 500 of the bristles including a greatest dimension in cross-section that is strictly less than $^{6.5}/_{100}$ of a millimeter (mm).

This small size of the bristles may reduce the risk of stripes being formed during application, and may make it possible to avoid an operation of grinding the bristles.

Any stripes that might be generated by the bristles while the composition is being applied and spread may be filled in more easily by the composition given their small width, and the small pressure exerted by the tuft of bristles.

Exemplary embodiments of the invention may make it possible to obtain an applicator brush that is easier to manufacture than a brush that is subjected to a grinding operation, while being capable of satisfactorily applying the composition. The composition may advantageously be suitable for deposition in a uniform layer, and in a relatively large quantity.

Where appropriate or desired, an applicator brush in exemplary embodiments may also provide more flexibility to the application.

In addition, since the applicator brush includes a large number of relatively fine bristles, the tuft of bristles may include less material and more air between the bristles than a tuft of bristles of identical overall size, but comprising a smaller number of thicker bristles. This makes it possible realize a savings in material, and to lower the cost of manufacture. The applicator brush may also retain more composition by capillarity between the bristles and on the tuft.

The bristles of the applicator brush may form a single tuft of bristles comprising at least 500 bristles, or a plurality of tufts of bristles of at least 500 bristles each.

Exemplary embodiments of the invention may provide an applicator brush including bristles that are identical or different. In exemplary embodiments, in addition to the at least 500 fine bristles, the applicator brush may include thicker bristles including a greatest dimension in cross-section that is greater than $^{6.5}/_{100}$ mm, for example.

In other exemplary embodiments, however, all of the bristles of the applicator brush may preferably include, in cross-section, a greatest dimension that is strictly less than $^{6.5}/_{100}$ mm. The greatest dimension may advantageously be less than or equal to $^{6}/_{100}$ mm, or less than or equal to $^{5.5}/_{100}$ mm, and better still less than or equal to $^{5}/_{100}$ mm, while also being greater than or equal to $^{3}/_{100}$ mm, for example.

A visible length of a portion of the bristles that extends beyond a distal end of the stem may lie in a range of 5 mm to 20 mm, or in a range of 10 mm to 17 mm, and better in a range of 12 mm to 14 mm.

In exemplary embodiments, a number of bristles in the applicator brush may lie in a range of 500 to 3600, for example, in a range of 600 to 3000, for example, in a range of 700 to 2000, or in a range of 750 to 1000, for example, about 880. The term "number of bristles" refers to the number of free ends that can be counted on the applicator brush after the applicator brush has been manufactured. For example, the bristles may come from a single tuft that has been folded in two. The number of bristles in the tuft may thus be half the number of bristles in the applicator brush.

A cross-section of at least one bristle may be substantially constant over an entire visible length of the bristle, or over at least half the length of the bristle starting from a free end of the bristle. In other exemplary embodiments, the section of at least one bristle may vary over at least a fraction of the visible length of the bristle, or over the entire visible length thereof.

At least one bristle may include a free end that does not taper. Preferably, none of the bristles includes a free end that has been subjected to a grinding operation. In other exemplary embodiments, at least one bristle may include a free end that tapers.

In exemplary embodiments, the bristles may be implanted in the stem. In other exemplary embodiments, the stem may be injection molded onto the bristles.

The bristles may be fastened by being stapled in a housing formed in a distal end of the stem. The bristles may be formed from a tuft that is folded in half about the staple. The bristles may also be held by clamping or by adhesive in a bottom of the housing.

The housing may comprise first and second cylindrical portions. The first portion may be closer to the distal end of the stem than the second portion, and may include a greater diameter.

In other exemplary embodiments, the first portion may be frustoconical. In such embodiments, the first portion may include a minimum diameter that is greater than a diameter of the second portion.

In exemplary embodiments, a stem including a housing that widens toward a free end thereof, for example, due to two cylindrical or truncated portions as defined above, may make it possible to aerate the bundle of bristles, for example, to avoid constraining the bristles at a base thereof, and to obtain good spreading of the composition, for example. It is also possible to slow down a flow of composition along the stem and the bristles, thereby lengthening a time the applicator brush can be used before being returned to the receptacle, and also reducing a risk of a drip forming at an end of the applicator brush.

In exemplary embodiments, a shape of the cross-section of the stem may be selected from: circular, non-circular, oblong, oval, elliptical, polygonal, square, rectangular, kidney-shaped, notched, and/or star-shaped, this list not being limiting.

On a periphery thereof, the stem may include one or more external grooves extending over at least a fraction of a length thereof. For example, the stem may include at least one groove, for example, encouraging the composition on the stem to flow into a predefined region of the bundle of bristles.

The stem may include a cross-section that is coaxial about a cross-section of the housing formed in a distal end thereof.

The stem may be configured to encourage an accumulation of composition on the stem, and to lengthen a time the applicator brush can be used before being returned to the receptacle.

For example, the stem may include a sheath forming, over at least a fraction of the length of the stem, a gap that is configured to receive and/or hold a reserve of composition.

A shape of the cross-section of a bristle may be selected from: solid, hollow, for example, solid circular or hollow circular, polygonal, for example, square, triangular or rectangular, elliptical, horseshoe-shaped, V-shaped, flat, and/or cross-shaped, this list being non-limiting. Bristles of the bundle may include at least one capillary channel.

Additives for modifying a surface state and/or a surface tension may be incorporated in a material of the bristles, for example, slip additives, for example, molybdenum disulfide, polytetrafluoroethylene (PTFE), and/or graphite.

The bristles may comprise a synthetic material selected, for example, from: polyamide (PA) 6,12, polyester, Rilsan®, polyamide, polyether, block polyamide-ether, polyethylene, PTFE, polyvinylidene fluoride, polyacetate, and/or polyethylene terephthalate.

At least one bristle may be an extrusion, i.e., manufactured by extrusion.

At least two bristles may be of diameters, shapes, and/or materials that are different. The stem may thus include a mixture of bristles that include different diameters and/or shapes, and/or that are of different materials.

At least one bristle may be wavy. Use of wavy bristles may make it possible to aerate the bundle of bristles. All of the bristles may be wavy, or, in other exemplary embodiments, the applicator brush may include a mixture both of wavy bristles and non-wavy bristles.

The bundle of bristles may be trimmed, so as to include a particular shape, for example, chamfered.

The stem may comprise a thermoplastic material, for example, selected from the group constituted by: polyolefins, for example, polyethylene or polypropylene, polyoxymethylene (POM), polyamide, polyethylene terephthalate (PET), and/or polybutyl terephthalate (PBT).

One end of the stem may include a fastener member that is configured to be fastened onto a handle.

For example, the fastener member may include an endpiece that is configured to be force-fitted and/or snap-fastened, or fastened in some other way, in the handle. The endpiece may include a tubular skirt with a collar at a base thereof.

The stem may be configured to co-operate in a leaktight manner with a receptacle containing the composition to be applied.

The handle may include fastener means for fastening onto a receptacle, for example, a thread.

The applicator brush may include a reserve of composition, for example, a nail varnish. The reserve of composition may be contained in a reservoir, for example, that is secured to the bundle of bristles during application, and/or in a gap formed around the stem by a sheath, for example, as described above.

The applicator brush may be configured to constitute a nail-varnish brush.

Exemplary embodiments of the invention may provide a packaging and applicator device for applying a cosmetic composition, the device comprising an applicator brush as defined above, and a receptacle containing the composition to be applied.

The composition may comprise a nail composition, i.e., a composition for application to the nails, for example, a nail varnish or a care product for the nails. In other exemplary embodiments, the composition may comprise a lipstick, for example.

BRIEF DESCRIPTION OF THE DRAWINGS

Various details of the present invention may will be better understood on reading the following detailed description of non-limiting embodiments, and on examining the accompanying drawings, in which:

FIG. 1 is a diagrammatic and fragmentary axial cross-sectional view of an exemplary packaging and applicator device;

FIG. 2 shows the stem and the bristles of the device of FIG. 1, in isolation;

FIG. 3 is a diagram showing the distal end of the stem of the device of FIG. 2;

FIG. 4 is a diagrammatic axial cross-sectional view showing another exemplary stem;

FIG. 5 is an axial cross-sectional view showing the distal end of the stem of FIG. 4, in isolation;

FIG. 6 is a view similar to FIG. 5 showing another exemplary embodiment;

FIGS. 7 to 11 are diagrammatic and fragmentary views showing trimmed bundles of bristles;

FIGS. 12 to 19 are cross-sectional views of exemplary stem sections taken at the housing receiving the bristles;

FIG. 20 is a view similar to FIG. 2 showing the exemplary embodiment of FIG. 19;

FIGS. 21 and 22 are cross-sectional views of exemplary stem sections;

FIGS. 23 and 24 are longitudinal cross-sectional views similar to FIG. 1 of two other exemplary embodiments;

FIGS. 25 to 34 are diagrams showing exemplary cross-sectional views of bristles; and FIG. 35 is a diagram showing an exemplary wavy bristle.

DETAILED DESCRIPTION OF EMBODIMENTS

FIGS. 1 to 3 show an exemplary packaging and applicator device 1 comprising a receptacle 2 containing a composition P for application, for example, a nail varnish, and an applicator brush 3 comprising a stem 4 that is extended at a distal end 20 by bristles 6 for applying the composition.

In the exemplary embodiment, the bristles 6 supported by the stem may include, in cross-section, a greatest dimension that is strictly less than $^{6.5}/_{100}$ mm, for example, lying in a range of $^{3}/_{100}$ mm to $^{6}/_{100}$ mm, for example, about $^{5}/_{100}$ mm.

A visible length L of the bristles extending beyond the stem 4 may lie in a range of 12 mm to 14 mm, for example.

The applicator brush 3 may include a large number of bristles, for example, in a range of 500 to 3600, for example, about 880 bristles in the exemplary embodiment.

The cross-section of at least one bristle 6 may be substantially constant over an entire visible length of the bristle.

At least one bristle 6 may include a free end that does not taper. Preferably, none of the bristles of the applicator brush has been subjected to grinding to taper an end thereof.

At one end 9, the stem 4 may include a fastener member 10 for engaging in a handle 15 that also comprises a closure cap for closing the receptacle.

The fastener member 10 may include an endpiece for snap-fastening or force-fitting in the handle 15. The collar 12 may make it possible to close the receptacle 2 in a sealed manner by coming to bear against a top surface of a neck 16 of the receptacle 2.

It is contemplated that the stem 4 may be fastened in the handle 15 in some other way, for example, by snap-fastening.

The stem 4 may also be made integrally, i.e., monolithically, with the handle.

As shown, the handle 15 may be provided internally with a thread 18 making it possible to screw the receptacle 2 onto the neck 16.

In the exemplary embodiment of FIGS. 1 to 3, the bristles 6 may be received in a housing 22 formed in the distal end 20 of the stem 4. For example, the bundle of bristles may be fastened in the housing 22 by a staple 25, as illustrated in FIG. 3, or by any other suitable means, for example, by adhesive, heat-sealing, punching the stem, and/or clamping.

FIGS. 4 and 5 show an exemplary embodiment in which the bristles 6 are fastened by clamping in a bottom of a housing 22 including two cylindrical portions of different diameters, namely, a first cylindrical portion 26 of greater diameter, and a second cylindrical portion 27 of smaller diameter, which defines the bottom of the housing 22, and in which the bristles 6 are held. Such a configuration may make it possible to obtain a bundle of bristles that behave better during application, for example, that are more effective in spreading the composition.

In other exemplary embodiments, in place of the first cylindrical portion, the housing 22 may include a frustoconical portion of minimum diameter that is greater than the diameter the second portion, as illustrated in FIG. 6.

In other exemplary embodiments, the distal end 20 of the stem 4 may be injection molded onto the bristles 6. In such embodiments, for example, the stem 4 may not need a housing 22 preformed at the distal end 20.

The bundle of bristles 6 may be given any shape, for example, with the bundle being trimmed while the bristles are in place on the stem. Free ends of the bristles 6 may be trimmed in such a manner that the end of the applicator is rectilinear as illustrated in FIG. 7, being perpendicular to an axis of the stem 4, or including a concave curved shape as illustrated in FIG. 8, or a convex shape as illustrated in FIG. 9, a chamfered shape as illustrated in FIG. 10, or even trimmed to a pointed shape as illustrated in FIG. 11.

The distal portion 20 of the stem 4 may be made with different cross-sections at the housing 22 for receiving the bristles 6. FIGS. 12 to 18 illustrate various exemplary cross-sections, amongst others.

For example, the stem 4 may be of circular cross-section as illustrated in FIG. 12, oblong as illustrated in FIG. 13, for example, oval or elliptical, polygonal as illustrated in FIGS. 14 and 15, for example, square or rectangular, kidney-shaped as illustrated in FIG. 16, star-shaped as illustrated in FIG. 17, or notched as illustrated in FIG. 18.

The stem 4 may include at least one longitudinal groove 30 that opens level with a middle of a long side of the housing containing the bristles, for example, as illustrated in FIGS. 19 to 21.

In the exemplary embodiment of FIG. 21, the cross-section of the stem may be coaxial about the cross-section of the housing, such that a thickness of the stem at the housing is constant over an entire periphery of the housing.

Where appropriate or desired, and as illustrated in FIGS. 22 and 23, the stem 4 may be surrounded by a sheath 32 that co-operates with the stem 4 to form a gap 33 in which composition may accumulate. The gap 33 may include a dimension that varies over an entire periphery of the stem 4. For example, a dimension of the gap 33 may be greater at the channels 30, thereby making it possible to accommodate greater reserves of composition at this location.

The applicator brush illustrated in FIGS. 22 and 23 may be used as follows. Before application, the receptacle 2 may be shaken with the closure cap 5 in place, thereby causing additional composition P to penetrate into the gap 33. When the applicator brush is removed from the receptacle 2, the composition P may remain contained in the gap 33. The applicator brush may thus be used for a relatively long period of time before being returned to the receptacle, thereby enabling varnish to be applied to a nail as a single layer, without any need to put the applicator brush back into the receptacle 2.

The composition in the gap 33 may thus come from the receptacle 2.

In other exemplary embodiments, the composition may come from a composition reservoir that is secured to the applicator brush during application.

For example, FIG. 24 illustrates an applicator brush 3 comprising a reservoir 35 containing the composition P, and a stem that is pierced with a channel 36 configured to deliver the composition to the bristles 6.

The bristles 6 may be of very different kinds. For example, it is possible to use bristles that include any one of the cross-sections illustrated in FIGS. 25 to 34. For example, the cross-section may be a hollow cross-section of circular outline as illustrated in FIG. 25, a solid cross-section of circular outline as illustrated in FIG. 26, a polygonal cross-section as illustrated in FIGS. 27 to 29, for example, square, triangular, or rectangular, or even an oblong cross-section, for example, of elliptical or oval outline as illustrated in FIG. 30, or even flat as illustrated in FIG. 31.

In other exemplary embodiments, the bristle 6 may include at least one capillary channel, as illustrated in FIGS. 32 to 34, the bristle including a cross-section of generally circular shape, for example, as illustrated in FIG. 32, or V-shaped as illustrated in FIG. 33, or cross-shaped as illustrated in FIG. 34.

The bristles in the bundle 6 may all be identical, or, in other exemplary embodiments, may comprise a mixture of bristles including shapes, cross-sections, and/or dimensions, for example, diameters, and/or materials that are different.

At least one bristle may be wavy, as illustrated in FIG. 35.

At least one bristle may comprise an extrusion, i.e., may be manufactured by extrusion.

The bristles may comprise at least one synthetic material selected, for example, from: polyamide (PA) 6,12, polyester, Rilsan®, polyamide, polyether, block polyamide-ether, polyethylene, PTFE, polyvinylidene fluoride, polyacetate, and/or polyethylene terephthalate.

Additives for modifying a surface state and/or a surface tension may be incorporated in the material of the bristles, for example, slip additives, for example, molybdenum disulfide, PTFE, and/or graphite.

The invention is not limited to the embodiments described above, and, for example, the characteristics of the various embodiments can be combined with one another.

The expression "comprising a" should be understood as being synonymous with "comprising at least one," unless specified to the contrary.

The expression "lying in a range of" should be construed as including their limits, unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator device for applying a cosmetic composition to the nails, the device comprising:

an applicator brush for applying the cosmetic composition, the applicator brush comprising:

a stem; and a single tuft of bristles that is supported by the stem, the tuft having greater than 600 and less than or equal to 1000 bristles, the bristles having, in cross-section, a greatest dimension that ranges from 4/100 mm to 6/100 mm; and a receptacle containing a nail composition.

2. A packaging and applicator device according to claim 1, wherein the greatest dimension in cross-section is not greater than 5.5/100 mm.

3. A packaging and applicator device according to claim 1, wherein the greatest dimension in cross-section is not greater than 5/100 mm.

4. A packaging and applicator device according to claim 1, wherein a visible length of the bristles lies in a range of about 5 mm to about 20 mm.

5. A packaging and applicator device according to claim 1, wherein a visible length of the bristles in the tuft lies in a range of about 10 mm to about 17 mm.

6. A packaging and applicator device according to claim 1, wherein a visible length of the bristles lies in a range of about 12 mm to about 14 mm.

7. A packaging and applicator device according to claim 1, wherein the number of bristles lies in a range of 750 to 1000.

8. A packaging and applicator device according to claim 1, wherein a cross-section of at least one bristle is substantially constant over an entire visible length of the bristle.

9. A packaging and applicator device according to claim 1, wherein at least one bristle includes a free end that does not taper.

10. A packaging and applicator device according to claim 9, wherein none of the bristles includes a ground free end.

11. A packaging and applicator device according to claim 1, wherein the tuft of bristles is stapled in a housing formed in a distal end of the stem.

12. A packaging and applicator device according to claim 11, wherein the housing comprises a first portion of greater minimum diameter, and a second cylindrical portion of smaller diameter, the first portion being one of cylindrical and frustoconical, and the second portion defining a bottom of the housing.

13. A packaging and applicator device according to claim 1, wherein the tuft of bristles is held by at least one of clamping and adhesive in a bottom of a housing formed in a distal end of the stem.

14. A packaging and applicator device according to claim 1, wherein the stem is injection molded onto the tuft of bristles.

15. A packaging and applicator device according to claim 1, wherein a shape of a cross-section of the stem is selected from: circular, non-circular, oblong, oval, elliptical, polygonal, square, rectangular, kidney-shaped, notched, and/or star-shaped, with one or more grooves on a periphery thereof.

16. A packaging and applicator device according to claim 1, wherein the stem includes a cross-section that is coaxial about a cross-section of a housing formed in a distal end of the stem.

17. A packaging and applicator device according to claim 1, wherein a shape of a cross-section of a bristle is selected from: solid, hollow, solid circular, hollow circular, polygonal, square, triangular, rectangular, elliptical, horseshoe-shaped, V-shaped, flat, and/or cross-shaped.

18. A packaging and applicator device according to claim 1, wherein at least one bristle includes a capillary channel.

19. A packaging and applicator device according to claim 1, wherein at least one additive configured to modify at least one of a surface state and a surface tension is incorporated in a material of the bristles.

20. A packaging and applicator device according to claim 1, wherein the bristles comprise a material selected from: PA 6,12, polyester, polyamide, polyether, block polyamide-ether, polyethylene, PTFE, polyvinylidene fluoride, polyacetate, and/or polyethylene terephthalate.

21. A packaging and applicator device according to claim 1, wherein at least two bristles include at least one of different diameters, shapes, and materials.

22. A packaging and applicator device according to claim 1, wherein at least one bristle is wavy.

23. A packaging and applicator device according to claim 1, wherein at least one bristle comprises an extrusion.

24. A packaging and applicator device according to claim 1, wherein the stem comprises a sheath forming, over at least a fraction of a length of the stem, a gap that configured to accommodate a reserve of composition.

25. A packaging and applicator device according to claim 1, wherein the stem comprises an end comprising a fastener member configured to be fastened onto a handle.

26. A packaging and applicator device according to claim 25, wherein the fastener member comprises an endpiece that is configured to be at least one of force-fitted and snap-fastened in a handle.

27. A packaging and applicator device according to claim 1, wherein the applicator brush further comprises a composition reservoir.

28. A packaging and applicator device according to claim 1, wherein the applicator brush is a nail-varnish brush.

* * * * *